US010116075B2

(12) United States Patent
Huang et al.

(10) Patent No.: US 10,116,075 B2
(45) Date of Patent: Oct. 30, 2018

(54) FLEXIBLE PRINTED CIRCUIT BOARD PLUG-IN JIG

(71) Applicants: BOE TECHNOLOGY GROUP CO., LTD., Beijing (CN); HEFEI BOE OPTOELECTRONICS TECHNOLOGY CO., LTD., Anhui (CN)

(72) Inventors: Gaoyu Huang, Beijing (CN); Peihuan Ning, Beijing (CN); Yannian Liu, Beijing (CN); Zhe Sun, Beijing (CN)

(73) Assignees: BOE Technology Group Co., Ltd., Beijing (CN); Hefei BOE Optoelectronics Technology Co., Ltd., Hefei, Anhui (CN)

( * ) Notice: Subject to any disclaimer, the term of this patent is extended or adjusted under 35 U.S.C. 154(b) by 0 days.

(21) Appl. No.: 14/744,587

(22) Filed: Jun. 19, 2015

(65) Prior Publication Data

US 2016/0141781 A1 May 19, 2016

(30) Foreign Application Priority Data

Nov. 17, 2014 (CN) ..... 2014 1 0653092

(51) Int. Cl.
*H01R 11/24* (2006.01)
*H01R 12/81* (2011.01)
(Continued)

(52) U.S. Cl.
CPC ..... *H01R 12/77* (2013.01)

(58) Field of Classification Search
CPC ..... H01R 13/64; H01R 12/61; H01R 12/592; H01R 12/53; H01R 12/59; H01R 11/24;
(Continued)

(56) References Cited

U.S. PATENT DOCUMENTS 4,936,792 A * 6/1990 Onoue ..... H01R 12/79 439/329
8,038,467 B2 * 10/2011 Shen ..... H01R 23/667 439/260
(Continued)

FOREIGN PATENT DOCUMENTS

CN 101038322 A 9/2007
CN 202259949 U 5/2012
(Continued)

OTHER PUBLICATIONS

English Translation of Masatsugu JP 2012037336, dated Feb. 23, 2012, Translated Feb. 21, 2017.*
(Continued)

*Primary Examiner* — Michael A Lyons
*Assistant Examiner* — Matthew T Dzierzynski
(74) *Attorney, Agent, or Firm* — Nath, Goldberg & Meyer; Joshua B. Goldberg

(57) ABSTRACT

The present invention provides a flexible printed circuit board (FPCB) plug-in jig, comprising a fixture part for clamping an FPCB, wherein the fixture part comprises a first clamping element and a second clamping element which are arranged oppositely; the first clamping element and the second clamping element are configured such that an opening is formed at one end of the fixture part and a pressing portion is formed at the other end of the fixture part; a signal matching board is arranged on a surface of the first clamping element facing the second clamping element; the signal matching board is used for electrically connecting to the FPCB at one end close to the opening of the fixture part; and an additional signal port is provided at another end of the signal matching board close to the pressing portion of the fixture part.

13 Claims, 2 Drawing Sheets

(51) Int. Cl.
*H01R 12/83* (2011.01)
*H01R 12/77* (2011.01)

(58) Field of Classification Search
CPC .... H01R 12/613; H01R 12/774; H01R 12/81; H01R 12/83; H01R 12/85; H01R 12/88; H01R 2201/20; H01R 4/48
See application file for complete search history.

(56) References Cited

U.S. PATENT DOCUMENTS

| | | | | |
|---|---|---|---|---|
| 8,740,477 | B2 * | 6/2014 | Tamura | G02B 6/3817 385/139 |
| 9,240,643 | B2 * | 1/2016 | Thies | H01R 12/81 |
| 2008/0139021 | A1 * | 6/2008 | Suzuki | G01R 1/0416 439/92 |
| 2010/0190373 | A1 * | 7/2010 | Yeh | H01R 12/774 439/499 |
| 2011/0091163 | A1 * | 4/2011 | Shimotsu | G02B 6/3883 385/76 |
| 2011/0111606 | A1 | 5/2011 | Lee | |

FOREIGN PATENT DOCUMENTS

| | | | |
|---|---|---|---|
| CN | 102830253 | A | 12/2012 |
| CN | 203590606 | U | 5/2014 |
| JP | 2012-37336 | A | 2/2012 |

OTHER PUBLICATIONS

First Office Action dated Jan. 5, 2016 corresponding to Chinese application No. 201410653092.3.
Office Action dated Sep. 30, 2016 issued in corresponding Chinese Application No. 201410653092.3.

* cited by examiner

FLEXIBLE PRINTED CIRCUIT BOARD PLUG-IN JIG

FIELD OF THE INVENTION

The present invention belongs to the technical field of manufacturing display devices, and particularly relates to a flexible printed circuit board plug-in jig.

BACKGROUND OF THE INVENTION

A flexible printed circuit board (FPCB) plug-in jig for a display module is an important element for introducing external signals into the display module.

The existing FPCB plug-in jig generally adopts a piano cover mode, namely a parent head of a piano cover of the FPCB plug-in jig for introducing matching signals is opened firstly, the FPCB of the display module is plugged into the parent head of the piano cover, and then the piano cover is closed to finish the plug-in process.

The inventor discovers that the prior art at least has the following problems: wires of the FPCB are easily damaged in the process of opening and closing the piano cover repeatingly; and because the opening of the parent head of the piano cover is very small, a relatively long time is needed for plugging the FPCB of the display module into the parent head of the piano cover, resulting in a reduced working efficiency.

SUMMARY OF THE INVENTION

Technical problems to be solved by the present invention include, in view of the above technical problems of the existing FPCB plug-in jig, providing an FPCB plug-in jig which is convenient in operation and reliable in performance.

A technical solution adopted for solving the technical problems of the present invention is an FPCB plug-in jig, including a fixture part for clamping an FPCB, wherein the fixture part includes a first clamping element and a second clamping element which are arranged oppositely; the first clamping element and the second clamping element are configured such that an opening is formed at one end of the fixture part and a pressing portion is formed at the other end of the fixture part; a signal matching board is arranged on a surface of the first clamping element facing the second clamping element; the signal matching board is electrically connected to the FPCB at one end close to the opening of the fixture part; and an additional signal port is provided at another end of the signal matching board close to the pressing portion of the fixture part.

The structure of the fixture part of the FPCB plug-in jig of the present invention is equivalent to a clamp, so the opening end of the fixture part can be opened by pressing the pressing portion of the fixture part; in this case, the FPCB is plugged into the opened opening end to electrically connect to the signal matching board; and external signals are introduced into the FPCB through the additional signal port at the end of the signal matching board close to the pressing portion, so that corresponding signals are provided to the display module. The FPCB plug-in jig of the present invention is simple in structure, easy to operate, safe and reliable, and can greatly reduce the loss of wires.

Preferably, a probe is arranged on the signal matching board at a position where the signal matching board is electrically connecting to the FPCB.

Preferably, a slot for accommodating the FPCB is formed in an end of the second clamping element close to the opening of the fixture part.

Preferably, when the pressing portion of the fixture part is subjected to a external pressing force, an end of the first clamping element close to the opening of the fixture part moves along an opposite direction of the force, while the second clamping element is immobilized.

Preferably, the pressing portion of the fixture part is provided with friction stripes.

Preferably, a protective board is arranged on a side of the signal matching board facing the second clamping element, wherein the protective board and the first clamping element are fixed to each other for protecting the signal matching board.

Preferably, the additional signal port of the signal matching board is a detachable port, so that different additional signal ports can be assembled on the signal matching board to match different additional signals.

DETAILED DESCRIPTION OF THE EMBODIMENTS

To make those skilled in the art better understand the technical solution of the present invention, the present invention will be further described in detail below in conjunction with the accompanying drawings and a specific embodiment.

Figure 1:
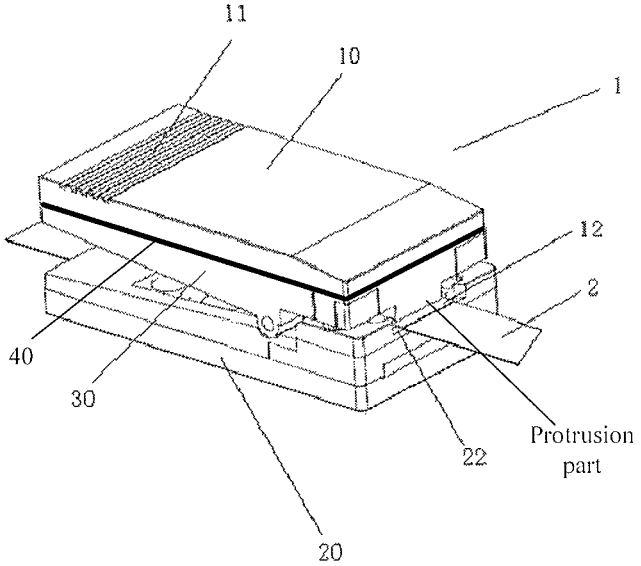
FIG. 1 is a schematic diagram of an FPCB plug-in jig according to an embodiment of the present invention.
Figure 2:
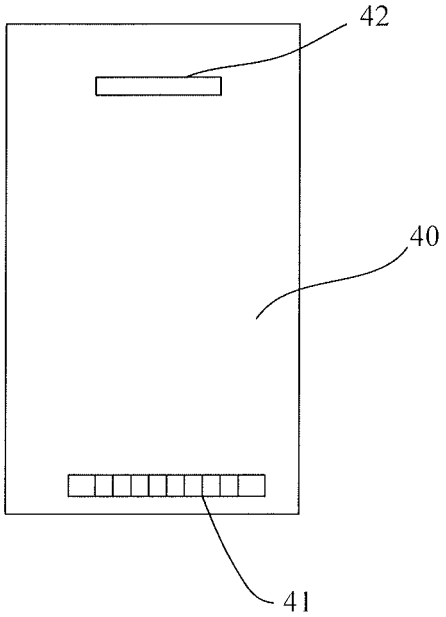
FIG. 2 is a schematic diagram of a signal matching broad of the FPCB plug-in jig according to the embodiment of the present invention.
Figure 3:
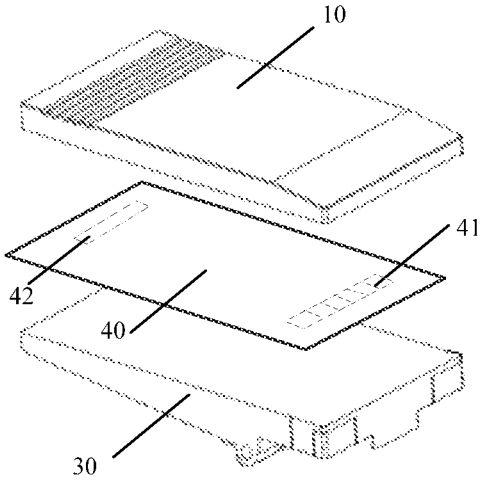
FIG. 3 is an exploded view of a part of the FPCB plug-in according to an embodiment of the present subject matter.

With reference to FIGS. 1 and 2, the exemplary embodiment in the present disclosure provides an FPCB plug-in jig 1, including a fixture part for clamping an FPCB, wherein the fixture part includes a first clamping element 10 and a second clamping element 20 which are arranged oppositely. The first clamping element 10 and the second clamping element 20 are configured such that an opening 12 is formed at one end of the fixture part and a pressing portion 11 is formed at the other end of the fixture part. As shown in FIG. 1, the end with the opening 12 is positioned on the right side of the FPCB plug-in jig 1 in the figure, while the other end with the pressing portion 11 is positioned on the left side of the FPCB plug-in jig 1 in the figure, but such a configuration mode is not limiting. A signal matching board 40 is arranged on a surface of the first clamping element 10 facing the second clamping element 20, and the specific structure thereof is shown in FIG. 2. The signal matching board 40 is electrically connected, at one end close to the opening 12 of the fixture part, with the FPCB plugged into the FPCB plug-in jig 1. Moreover, an additional signal port 42 is provided at another end of the signal matching board 40 close to the pressing portion 11 of the fixture part.

The structure of the fixture part of the FPCB plug-in jig 1 in this embodiment is equivalent to a clamp, so the end with the opening 12 of the fixture part can be opened by pressing the pressing portion 11 of the fixture part. At the moment, as shown in FIG. 1, the FPCB 2 is plugged into the opened opening 12 to electrically connect to the signal matching board 40. The additional signal port 42 is formed at the other end of the signal matching board 40 close to the pressing portion 11, so that external signals can be introduced into the FPCB 2 through the additional signal port 42, in order to provide corresponding signals to the display module. The FPCB plug-in jig 1 in this embodiment is simple in structure, easy to operate, safe and reliable, and can greatly reduce the loss of wires.

Preferably, a probe 41 is arranged on the signal matching board 40 at a position where the signal matching board 40 electrically connecting to the FPCB 2. The probe 41 ensures that the FPCB 2 can be well electrically connected to the signal matching board 40, so as to improve the reliability of the FPCB plug-in jig 1.

Preferably, a slot 22 for accommodating the FPCB 2 is formed in an end of the second clamping element 20 close to the opening 12 of the fixture part. The end of the slot 22 deep into the second clamping element 20 from the opening 12 is equivalent to a retaining wall, which plays a role of fixing the plug-in position of the FPCB 2 and avoids the situation that the FPCB 2 cannot be well electrically connected to the signal matching board 40 due to the inaccurate plug-in position.

Preferably, in the example shown in the figures, when the pressing portion 11 of the fixture part is subjected to a downward external pressing force, an end of the first clamping element 10 close to the opening 12 of the fixture part moves along an opposite direction of the force, while the second clamping element 20 is immobilized.

That is to say, the fixture part in this embodiment has a structure that is movable on one side and fixed on the other side, so that the clamped FPCB 2 is more stable.

Preferably, the pressing portion 11 of the fixture part is provided with friction stripes, thus avoiding pressing difficulty and even failure resulting from the fact that an external force applying body slips from the pressing portion 11 due to excessive smoothness of the pressing portion 11 when the external force applying body applies an external force to the pressing portion 11.

Preferably, a protective board 30 is arranged on a side of the signal matching board 40 facing the second clamping element 20, and the protective board 30 and the first clamping element 10 are fixed to each other for protecting the signal matching board 40.

Preferably, the additional signal port 42 of the signal matching board 40 is a detachable port, so that different additional signal ports 42 for different additional signals can be assembled on the signal matching board 40 to match different additional signals. That is to say, the FPCB plug-in jig 1 of this embodiment is applicable to FPCBs of different types, so that the FPCB plug-in jig 1 of this embodiment has a wider application range.

It could be understood that the above embodiments are merely exemplary embodiments adopted for describing the principle of the present invention, however the present invention is not limited thereto. Various modifications and improvements may be made by those of ordinary skill in the art without departing from the spirit and essence of the present invention, and these modifications and improvements are also considered to be within the protection scope of the present invention.

The invention claimed is:

1. A flexible printed circuit board (FPCB) plug-in jig, comprising a fixture part for clamping an FPCB, wherein the fixture part comprises a first clamping element and a second clamping element which are arranged oppositely; the first clamping element and the second clamping element are configured such that an opening is formed at one end of the fixture part and a pressing portion is formed at the other end of the fixture part, the pressing portion being provided on the first clamping element so that the second clamping element is immobilized and one end of the first clamping element proximal to the opening moves away from the second clamping element when the pressing portion is subjected to an external force;

a signal matching board is arranged on a surface of the first clamping element facing the second clamping element; the signal matching board is used for electrically connecting to the FPCB at one end close to the opening of the fixture part; and an additional signal port is provided at another end of the signal matching board close to the pressing portion of the fixture part, wherein a protective board is arranged on a side of the signal matching board facing the second clamping element, the protective board is configured to separate from and parallel to the first clamping element, the protective board is further configured to be fixed to the first clamping element and rotatably connected to the second clamping element directly so as to drive the first clamping element to move with respect to the second clamping element, and a slot for accommodating the FPCB is provided at an end of the second clamping element close to the opening of the fixture part, the fixture part further comprises a protrusion part provided at an end of the protective board close to the opening of the fixture part and protruding towards the second clamping element, and the protrusion part is configured to be accommodated in the slot provided at the second clamping element when the first clamping element is pressed to move towards the second clamping element.

2. The FPCB plug-in jig of claim 1, wherein a probe is arranged on the signal matching board at a position where the signal matching board is electrically connecting to the FPCB.

3. The FPCB plug-in jig of claim 1, wherein the pressing portion of the fixture part is provided with friction stripes.

4. The FPCB plug-in jig of claim 2, wherein the pressing portion of the fixture part is provided with friction stripes.

5. The FPCB plug-in jig of claim 1, wherein the protective board and the first clamping element are fixed to each other for protecting the signal matching board.

6. The FPCB plug-in jig of claim 2, wherein the protective board and the first clamping element are fixed to each other for protecting the signal matching board.

7. The FPCB plug-in jig of claim 1, wherein the additional signal port of the signal matching board is a detachable port, so that different additional signal ports can be assembled on the signal matching board to match different additional signals.

8. The FPCB plug-in jig of claim 2, wherein the additional signal port of the signal matching board is a detachable port, so that different additional signal ports can be assembled on the signal matching board to match different additional signals.

9. The FPCB plug-in jig of claim 1, wherein the pressing portion of the fixture part is provided with friction stripes.

10. The FPCB plug-in jig of claim 1, wherein the protective board and the first clamping element are fixed to each other for protecting the signal matching board.

11. The FPCB plug-in jig of claim 1, wherein the additional signal port of the signal matching board is a detachable port, so that different additional signal ports can be assembled on the signal matching board to match different additional signals.

12. The FPCB plug-in jig of claim 1, wherein in a case where the protrusion part is accommodated in the slot and a FPCB is inserted into the opening, the protrusion part, the FPCB and the slot are arranged sequentially in a vertical direction.

13. The FPCB plug-in jig of claim 1, wherein the protrusion part is configured to be accommodated in the slot in a case where the first clamping element moves towards the second clamping element while outside the slot and in a case where the first clamping element moves away from the second clamping element.

* * * * *